US008360140B2

(12) United States Patent
Zabelka

(10) Patent No.: US 8,360,140 B2
(45) Date of Patent: Jan. 29, 2013

(54) WELL HEAD LUBRICATOR ASSEMBLY

(75) Inventor: Scott E. Zabelka, Plainfield, IL (US)

(73) Assignee: Miner Elastomer Products Corporation, Geneva, IL (US)

( * ) Notice: Subject to any disclaimer, the term of this patent is extended or adjusted under 35 U.S.C. 154(b) by 385 days.

(21) Appl. No.: 12/661,401

(22) Filed: Mar. 16, 2010

(65) Prior Publication Data

US 2011/0226464 A1 Sep. 22, 2011

(51) Int. Cl.
*E21B 33/05* (2006.01)

(52) U.S. Cl. ..... 166/70; 166/86.2; 267/153

(58) Field of Classification Search ..... 166/70, 166/72, 75.13, 94.1, 86.2; 267/70, 153, 71
See application file for complete search history.

(56) References Cited

U.S. PATENT DOCUMENTS

| | | | |
|---|---|---|---|
| 2,347,101 | A | 4/1944 | Harding |
| 3,181,470 | A | 5/1965 | Clingman |
| 3,339,004 | A | 8/1967 | Nardone |
| 3,806,106 | A | 4/1974 | Hamel et al. |
| 3,902,469 | A | 9/1975 | Scott, Jr. |
| 4,015,616 | A | 4/1977 | Hanff |
| 4,176,714 | A | 12/1979 | Case |
| 4,198,037 | A | 4/1980 | Anderson |
| 4,354,397 | A | 10/1982 | Fix |
| 4,445,674 | A | 5/1984 | Clayton, Jr. |
| 4,475,722 | A | 10/1984 | Paton et al. |
| 4,566,678 | A | 1/1986 | Anderson |
| 4,833,973 | A | 5/1989 | Wang et al. |
| 4,900,503 | A | 2/1990 | Hegler et al. |
| 4,962,916 | A | 10/1990 | Palinkas |
| 5,000,215 | A | 3/1991 | Phillips |
| 5,052,665 | A | 10/1991 | Sakuragi |
| 5,141,697 | A | 8/1992 | Wydra |
| 5,192,057 | A | 3/1993 | Wydra et al. |
| 5,326,083 | A | 7/1994 | Wydra et al. |
| 5,460,357 | A | 10/1995 | Stewart |

(Continued)

OTHER PUBLICATIONS

Well Master Corporation; Components of a Plunger Lift System; 2008; 4 pages.

*Primary Examiner* — David Andrews
*Assistant Examiner* — Taras P Bemko
(74) *Attorney, Agent, or Firm* — Law Office of John W. Harbst

(57) ABSTRACT

A well head lubricator assembly including an elongated rigid tubular body defining an interior chamber open at a lower end to receive a plunger at a well head. The plunger is slidably positioned within the chamber in response to forces or loads acting thereon and has a seat arranged toward an upper end thereof. An upper end of the tubular body is closed. An axially elongated one-piece thermoplastic ether ester elastomer spring is slidingly positioned within the interior chamber of the tubular body. One end of the spring is seated on the seat of the plunger. The spring defines an elongated bore opening to opposed ends thereof. Moreover, the spring is provided with a plurality of axially spaced flange sections along a length thereof for guiding the spring for endwise sliding movement on an inside diameter of the tubular body. Any two flange sections on the spring are axially separated by an energy absorbing section for allowing the spring to react to energy imparted to the plunger. Each energy absorbing section on the spring defines a wall having a lateral thickness ranging between about 20% to about 30% of an axial length of the energy absorbing section extending axially between any two adjacent flange sections and such that radial expansion of the energy absorbing sections is limited to about an outermost edge of the flange sections.

14 Claims, 2 Drawing Sheets

U.S. PATENT DOCUMENTS

| | | | | |
|---|---|---|---|---|
| 5,467,970 | A | 11/1995 | Ratu et al. | |
| 5,704,474 | A | 1/1998 | Oland | |
| 5,868,384 | A | 2/1999 | Anderson | |
| 5,957,441 | A | 9/1999 | Tews | |
| 6,250,617 | B1 | 6/2001 | Tews | |
| 6,520,271 | B1 * | 2/2003 | Martini | 175/21 |
| 6,571,868 | B2 | 6/2003 | Victor | |
| 7,669,648 | B2 | 3/2010 | Victor | |

* cited by examiner

WELL HEAD LUBRICATOR ASSEMBLY

FIELD OF THE INVENTION DISCLOSURE

The present disclosure generally relates to gas producing wells and, more specifically, to an improved well head lubricator assembly for use in combination with gas producing wells.

BACKGROUND OF THE INVENTION DISCLOSURE

As known to those skilled in the art, gas producing wells typically employ a gas lift plunger slidably arranged within tubing of a well. The plunger slidably moves vertically within the tubing as the gas well is cycled between shut-in and opened conditions. More specifically, the plunger vertically rises under the effect of sufficient gas pressure to drive or lift the plunger and a slug or liquid, typically oil, above it to the surface or well head while isolating the base of the liquid slug from the gas lifting the plunger. After the slug of liquid is delivered to the surface and the pressure of the gas flowing from the well tubing has decreased below the gravitational force or energy acting on the plunger, the plunger falls back or is returned to its initial position in the well tubing.

One conventional lubricator assembly includes an elongated rigid tubular member defining an interior chamber closed at an upper end thereof. A strike plate or plunger is arranged in the chamber of the elongated tubular member toward a lower end portion thereof. An elongated coil spring is also arranged within the interior of the chamber between the closed upper end of the tubular member and the lower plunger. Typically, the coil spring is made from a conventional steel and is intended to absorb the relatively high impact forces or loads generated by the plunger and thereby protecting the remaining structure of the lubricator assembly against damage from the relatively high pressure liquids and gases acting on the lubricator assembly.

Under some operating conditions, and for various reasons, the spring arranged in operable combination with the lubricator assembly sometimes fails and collapses. On occasion, the failure of the spring can occur within relatively short periods of time. Of course, the collapse and failure of the spring results in the plunger being driven, under the relatively high force or loads acting thereon, against the closed end of the tubular body. Without a sufficient bias on the plunger, the relatively high forces or loads acting on the well head are known to be sufficient to cause significant damage to the tubular body of the lubricator assembly. As such, operation of the well is halted to effect the necessary repairs and or replacement of broken and damaged components.

Thus, there is a need and continuing desire for a well head lubricator assembly which is designed to overcome the heretofore and other known problems and drawbacks.

SUMMARY

In view of the above, and in accordance with one aspect, there is provided a well head lubricator assembly including an elongated rigid tubular body having an upper end and a lower end and defining an interior chamber open at the lower end to receive a plunger at a well head. A cap is provided for closing the interior chamber at the upper end of said tubular body. An axially elongated one-piece thermoplastic ether ester elastomer spring is also provided. The spring defines an elongated bore opening to opposed ends thereof. The spring has a plurality of axially spaced flange sections along a length thereof.

Each flange section has an outer diameter which is substantially equal to an inside diameter of the tubular body such that the flange sections axially guide the spring within the tubular body. Any two flange sections on the spring are axially separated by an energy absorbing section for allowing the spring to react to energy imparted to the plunger. Each energy absorbing section of the spring is in the form of a ring whose lateral outer face is curved toward an exterior of the spring. Each energy absorbing section on the spring defines a wall having a generally constant cross-section ranging between about 17.5% to about 27.6% of an axial length of the energy absorbing section extending axially between any two adjacent flange sections and such that radial expansion of the energy absorbing sections is limited to about the outer diameter of the flange sections.

Preferably, the one-piece thermoplastic ether ester elastomer spring is made from an elastomer having a Shore D hardness ranging between about 40 and about 72. In one form, the each energy absorbing section on the spring defines a wall having a generally constant cross-section of about 24.6% of an axial length of the energy absorbing section extending axially between any two adjacent flange sections.

In a preferred form, the cap of the well head lubricator assembly is releasably secured to the tubular body. In one embodiment, the tubular body of the well head lubricator assembly has a substantially cylindrical configuration.

The elastomer spring of the well head lubricator assembly preferably defines at least one radial bore opening to the central bore of and to an exterior of the spring. In one embodiment, the radial opening in the elastomeric spring is defined in one of the energy absorbing sections of the spring.

According to another aspect there is provided a well head lubricator assembly including an elongated rigid tubular body defining an interior chamber open at a lower end to receive a plunger at a well head. The plunger is slidably positioned within the chamber in response to forces or loads acting thereon and has a seat arranged toward an upper end thereof. An upper end of the tubular body is closed. An axially elongated one-piece thermoplastic ether ester elastomer spring is slidably positioned within the interior chamber of the tubular body. One end of the spring is seated on the seat of the plunger. The spring defines an elongated bore opening to opposed ends thereof. Moreover, the spring is provided with a plurality of axially spaced flange sections along a length thereof for guiding the spring for endwise sliding movement on an inside diameter of the tubular body. Any two flange sections on the spring are axially separated by an energy absorbing section for allowing the spring to react to energy imparted to the plunger. Each energy absorbing section has a lateral outer face which is curved toward an exterior of the spring. Each energy absorbing section on the spring defines a wall having a generally constant cross-section ranging between about 20% to about 30% of an axial length of the energy absorbing section extending axially between any two adjacent flange sections and such that radial expansion of the energy absorbing sections is limited to about an outermost edge of the flange sections.

Preferably, the one-piece thermo-elastic ether ester elastomer spring is made from an elastomer having a Shore D hardness ranging between about 40 and about 72. In a preferred form, the each energy absorbing section on the spring defines a wall having a generally constant cross-section of about 25% of an axial length of the energy absorbing section extending axially between any two adjacent flange sections on the spring.

In a preferred form, the upper end of the tubular body of the well head lubricator assembly is releasably closed by a cap. In one embodiment, the tubular body for the well head lubricator assembly has a substantially cylindrical configuration.

The elastomer spring of the well head lubricator assembly preferably defines at least one radial bore opening to the central bore of and to an exterior of the spring. In one embodiment, the radial opening in the elastomeric spring is defined in one of the energy absorbing sections of the spring.

DETAILED DESCRIPTION

Figure 1:
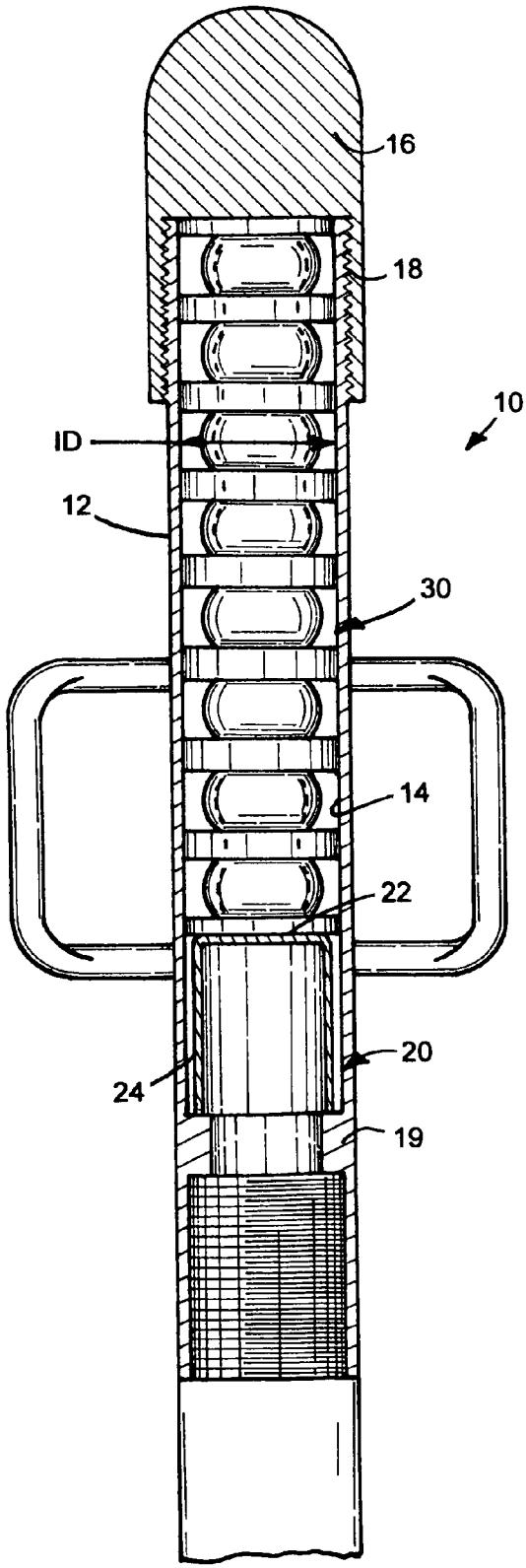
FIG. 1 is a longitudinal sectional view of a gas well lubricator assembly embodying principals of this invention disclosure.

While this invention disclosure is susceptible of embodiment in multiple forms, there is shown in the drawings and will hereinafter be described a preferred embodiment, with the understanding the present disclosure sets forth an exemplification of the disclosure which is not intended to limit the disclosure to the specific embodiments illustrated and described.

Referring now to the drawings, wherein like reference numerals indicate like parts throughout the several views, there is shown in FIG. 1 a gas well lubricator assembly, generally indicated by reference numeral 10. The gas well lubricator assembly includes an elongated rigid tubular body 12 defining an interior chamber 14. In the illustrated embodiment, the tubular body 12 has a generally cylindrical configuration and is open at opposed ends thereof. In a most preferred form, the tubular body 12 is formed from steel or other suitably strong metal.

A cap 16 is arranged toward an upper end 18 of the tubular body 12 to close one end of the chamber 14. Preferably, cap 16 is releasably or removably attached to the upper end 18 of the tubular body 12.

Toward a lower end 18 of the tubular body, the gas well lubricator assembly 10 includes a strike plate or plunger 20 which is slidably positioned within the interior chamber 14. In one form, the plunger 20 includes a generally horizontally disposed upper seat 22 with wall structure 24 depending from the upper seat 22 for guiding the plunger 20 for reciprocatory sliding movements within the interior chamber 14 of the tubular body 12 in response to loads or forces acting thereon.

Figure 2:
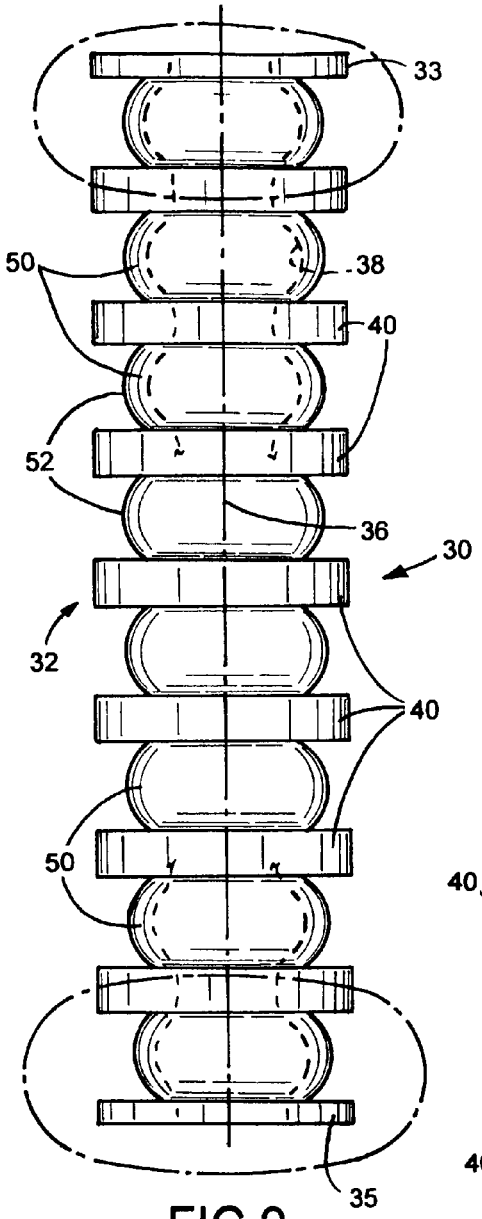
FIG. 2 is an enlarged side elevational view of a thermo-plastic ether ester elastomer spring forming part of the gas well lubricator assembly.
Figure 3:
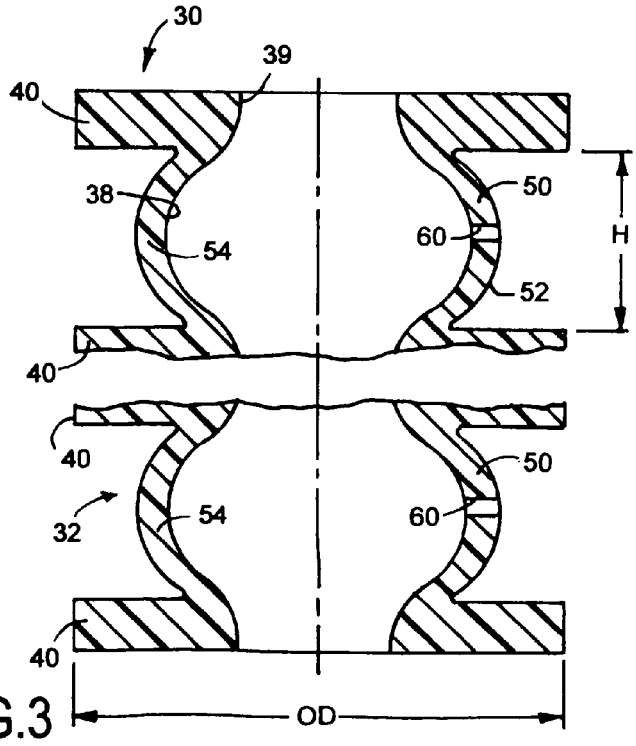
FIG. 3 is a fragmentary enlarged sectional view of that area of the thermo-plastic ether ester elastomer spring encircled in phantom lines in FIG. 2

A one-piece thermoplastic ether ester elastomer spring 30 is slidingly positioned within the interior chamber 14 of the tubular body 12 operably between cap 16 and the upper seat 22 of plunger 20 for absorbing and dissipating energy imparted to the plunger 20 during operation of the gas well lubricator 10. As shown in FIG. 2, the one-piece thermoplastic ether ester elastomer spring 30 includes an axially elongated body 32 having a generally cylindrical configuration between opposed ends 33 and 35 and has a longitudinal axis 36. Moreover, the one-piece thermoplastic ether ester elastomer spring 30 defines an elongated bore 38 opening to opposed ends 33, 35 and which is generally coaxially aligned with the longitudinal axis 36 of the spring 30. As shown in FIG. 3, the bore 38 has a closed margin 39 about a diameter thereof.

To slidably guide it within the tubular body 14, spring 30 is provided with a plurality of axially spaced flange sections 40 along a length thereof. Each flange section 40 has an outer diameter OD (FIG. 3) which substantially equals an inside diameter ID (FIG. 1) of the tubular body 12 such that the flange sections 40 cooperate with each other to axially guide spring 30 within the tubular body 12.

As shown in FIG. 2, any two flange sections 40 on spring 30 are axially separated by an axially elongated energy absorbing section 50 for allowing the spring 30 to react to energy imparted to the plunger 20 during operation of the gas well lubricator assembly 10. Each energy absorbing section or convolute 50 of spring 30 has the form of a ring whose lateral outer face 52 is curved toward an exterior of spring 30. Moreover, and as shown in FIG. 3, each energy absorbing section 50 on spring 30 extending between any two axially adjacent flange sections defines a wall 54 having a generally constant cross-section ranging between about 20% to about 30% of an axial length H of the respective energy absorbing section. In one form, each energy absorbing section 50 on spring 30 extending between any two axially adjacent flange sections 40 defines a wall 54 having a generally constant cross-section ranging between about 17.5% to about 27.6% of an axial length H of the respective energy absorbing section such that radial expansion of the energy absorbing sections 50 is limited to about the outer diameter OD of the flange sections 40. In a most preferred form, each energy absorbing section 50 on spring 30 defines a wall 54 having a generally constant cross-section of about 24.6% of an axial length H of the energy absorbing section extending axially between any two adjacent flange sections 40.

The thermo-plastic ether ester elastomer for spring 30 is initially created as a preform. An elastomer having tensile characteristics such that the ratio of plastic strain to elastic strain is greater than 1.5 to 1 has proven particularly beneficial. The preferred elastomer is one manufactured and sold by E. I. DuPont de Nemoirs under the trademark Hytrel®. Notably, however, suitable elastomer materials other than Hytrel® would equally suffice without detracting or departing from the spirit and scope of this disclosure. Preferably, the elastomeric material used to form spring 30 has a molecular structure and a Shore D durometer hardness ranging between about 50 and 60. The most preferred embodiment form for the elastomer used to form spring 30 has a Shore D durometer of about 55. Notably, the elastomer material forming the elastomer is free of spring-like characteristics and is reasonably inert. Significantly, such elastomer is quite durable and has an excellent flex life. Moreover, such elastomer is not subject to tearing or to crack propagation even in relatively thin cross-sections. For a more complete description of this elastomer, attention is directed to U.S. Pat. No. 4,198,037 to D. G. Anderson; applicable portions of which are incorporated herein by reference.

Normally, the selected elastomer material is purchased in pellet form, and is injected or extruded into a mold to form the preform. Various plastic molding techniques such as melt casting, injection molding, rotational molding, etc, can be used to fabricate the preform.

After fabricating the preform, the elastomer used in combination with the cushioning apparatus, is preferably cold-formed or worked in a manner orienting the molecular structure of the elastomer material. The phrase or term "working" or "worked" means and refers to controllably manipulating the preform after it is formed. More specifically, and in accordance with one spring making process, after the preform is fabricated, the preform is controllably manipulated as by axially squeezing or compressing the preform within a press and in a predetermined axial direction, by more than 30% to 35% of the initial length of the preform. Axial compression of the preform causes the molecular structure of the elastomer to become orientated in at least one direction and transmutes the preform into a spring having a predetermined spring rate.

After the preform is axially compressed, the preform takes a compression spring shape or "set". As worked, the preform is free of compression set problems and, upon subsequent compressions, that is, when the resultant spring is again radially compressed, such compression spring will provide a repeatable and substantially constant spring rate and will constantly return or spring back to its formed shape. In part, the "spring back" characteristics, as well as the spring rate characteristics of the preform, result from the orientation of the molecules of Hytrel®

As mentioned, the elastomer material used to form the spring 30 is reasonably inert and not subject to tearing or to crack propagation even in relatively thin cross-sections. Making the spring 30 from an elastomer which is inert permits the spring 30 to function in an environment of the type found in gas wells where caustic gases and liquids tend to quickly cause deterioration and breakage of the spring arranged in operable combination within the reciprocating plunger 20. As shown in FIG. 3, and since the elastomer used to form spring 30 is not subject to tearing or crack propagation, one or more of the energy absorbing sections 50 on the spring 30 defines a radial bore 60 which opens to the elongated bore 38 and to an exterior of the respective energy absorbing section 50 whereby inhibiting blockages within the bore 38 so as facilitate continued and proper operation of the spring 30 and the gas well lubricator assembly 10.

In one form, the spring body has a length of about 10.9 inches and the flange sections 40 have about a 2.4 inch diameter. In the illustrated example, the wall thickness of each convolute or energy absorbing section is about 0.16 inches and an axial length of about 0.77 inches. Of course, and depending upon the particular application, spring 30 can have other combinations of designs without detracting or departing from the spirit and scope of this invention disclosure.

From the foregoing, it will be observed that numerous modifications and variations can be made and effected without departing or detracting from the true spirit and novel concept of this invention disclosure. Moreover, it will be appreciated, the present disclosure is intended to set forth an exemplification which is not intended to limit the disclosure to the specific embodiment illustrated. Rather, this disclosure is intended to cover by the appended claims all such modifications and variations as fall within the spirit and scope of the claims.

What is claimed is:

1. A well head lubricator assembly, comprising:

an elongated rigid tubular body having an upper end and a lower end and defining an interior chamber open at said lower end to receive a plunger at a well head, with a cap for closing said interior chamber at said upper end of said tubular body; and an axially elongated one-piece thermo-plastic ether ester elastomer spring defining an elongated bore opening to opposed ends thereof and which is generally coaxially aligned with a longitudinal axis of said spring, with said bore having a closed margin about a diameter thereof, and with said spring having a plurality of axially spaced flange sections along a length thereof, with each flange section having an outer diameter which is substantially equal to an inside diameter of the tubular body such that said flange sections axially guide said spring within said tubular body, and with any two axially adjacent flange sections on said spring being axially separated by an axially elongated energy absorbing section for allowing said spring to react to energy imparted to said plunger, and with each energy absorbing section having the form of a ring whose lateral outer face is curved toward an exterior of said spring, and wherein each energy absorbing section on said spring extending between any two axially adjacent radial flanges defines a wall having a generally constant cross-section ranging between about 17.5% to about 27.6% of an axial length of the respective energy absorbing section such that, upon axial compression of said spring, said energy absorbing sections radially expand outwardly toward an inner diameter of said tubular body.

2. The well head lubricator assembly according to claim 1 wherein said one-piece thermo-elastic ether ester elastomer spring is made from an elastomer having a Shore D hardness ranging between about 50 and about 60.

3. The well head lubricator assembly according to claim 1 wherein the generally constant cross-section of the wall of each energy absorbing section on said spring defines a wall having a lateral thickness of is about 24.6% of the axial length of said energy absorbing section extending axially between any two adjacent flange sections.

4. The well head lubricator assembly according to claim 1 wherein said cap is releasably secured to said tubular body.

5. The well head lubricator assembly according to claim 1 wherein said tubular body has a substantially cylindrical configuration.

6. The well head lubricator assembly according to claim 1 wherein said elastomer spring further defines at least one radial bore opening to said elongated bore and to an exterior of said spring.

7. The well head lubricator assembly according to claim 6 wherein said radial opening is defined in at least one of the energy absorbing sections of said spring.

8. A well head lubricator assembly, comprising:

an elongated rigid tubular body defining an interior chamber open at a lower end to receive a plunger at a well head, with said plunger being slidably positioned within said chamber in response to forces acting thereon and has a seat arranged toward one end thereof, and wherein an upper end of said tubular body is closed; and an axially elongated one-piece thermo-plastic ether ester elastomer spring slidingly positioned within the interior chamber of said tubular body, with one end of said spring being operably seated on the seat of said plunger, and with said spring defining an elongated bore opening to opposed ends thereof and which is generally coaxially aligned with a longitudinal axis of said spring, with said elongated bore having a closed margin about a diameter thereof, with said spring having a plurality of axially spaced flange sections along a length thereof for guiding said spring for endwise sliding movement on an inside diameter of the tubular body, and with any two axially adjacent flange sections on said spring being axially separated by an energy absorbing section for allowing said spring to react to energy imparted to said plunger, and with each energy absorbing section having the form of a ring whose lateral outer face is curved toward an exterior of said spring, and wherein each energy absorbing section on said spring extending between any two axially adjacent radial flanges defines a wall having a generally constant cross-section ranging between about 20% to about 30% of an axial length of said energy absorbing section extending axially between any two adjacent flange sections such that, upon axial compression of said spring, said energy absorbing sections radially expand toward an inner diameter of said tubular body.

9. The well head lubricator assembly according to claim 8 wherein said one-piece thermo-elastic ether ester elastomer spring is made from an elastomer having a Shore D hardness ranging between about 50 and about 60.

10. The well head lubricator assembly according to claim 8 wherein the generally constant cross-section of the wall of each energy absorbing section on said spring defines a wall having a lateral thickness of is about 25% of the axial length of said energy absorbing section extending axially between any two adjacent flange sections.

11. The well head lubricator assembly according to claim 8 wherein the upper end of said tubular body is releasably closed by a cap.

12. The well head lubricator assembly according to claim 8 wherein said tubular body has a substantially cylindrical configuration.

13. The well head lubricator assembly according to claim 8 wherein said elastomer spring further defines at least one radial bore opening to said elongated bore and to an exterior of said spring.

14. The well head lubricator assembly according to claim 13 wherein said radial opening is defined in at least one of the energy absorbing sections of said spring.

* * * * *